United States Patent [19]

Haigh et al.

[11] 4,076,200

[45] Feb. 28, 1978

[54] SUPPORTED VESSEL AND MEANS FOR SUPPORT THEREOF

[75] Inventors: Harold Edward Haigh, Stockton on Tees; Dietrich Adolf Hofmann, Newcastle on Tyne, both of England

[73] Assignee: Tioxide Group Limited, Billingham, England

[21] Appl. No.: 727,589

[22] Filed: Sep. 28, 1976

[30] Foreign Application Priority Data

Nov. 6, 1975 United Kingdom ..... 46093/75

[51] Int. Cl.[2] ..... B65D 25/24

[52] U.S. Cl. ..... 248/146; 220/18

[58] Field of Search ..... 248/146, DIG. 1, 311.1; 220/9 LG, 9 A, 15, 18; 114/74 R, 72, 25, 74 T; 122/510

[56] References Cited

U.S. PATENT DOCUMENTS

| | | | |
|---|---|---|---|
| 735,122 | 8/1903 | Lugibihl et al. | 220/15 |
| 1,771,581 | 7/1930 | Moon | 248/146 |
| 3,301,518 | 1/1967 | Yetter et al. | 248/311.1 |
| 3,792,795 | 2/1974 | Sikora | 220/18 |

FOREIGN PATENT DOCUMENTS

| | | | |
|---|---|---|---|
| 69,540 | 10/1969 | Germany | 248/146 |
| 7,104,141 | 9/1971 | Netherlands | 248/146 |

*Primary Examiner*—Marion Parsons, Jr.

*Attorney, Agent, or Firm*—Schuyler, Birch, Swindler, McKie & Beckett

[57] ABSTRACT

A supported vessel having a number of outwardly directed projections on the side of the vessel which are fixed to the outer end of horizontally disposed webs, the inner end of the webs being supported on a supporting structure, the lower end of which is secured in the ground, the weight of the vessel being transmitted to the webs through the support structure. The invention also claims a support for such a supported vessel.

8 Claims, 10 Drawing Figures

SUPPORTED VESSEL AND MEANS FOR SUPPORT THEREOF

Figure 1:
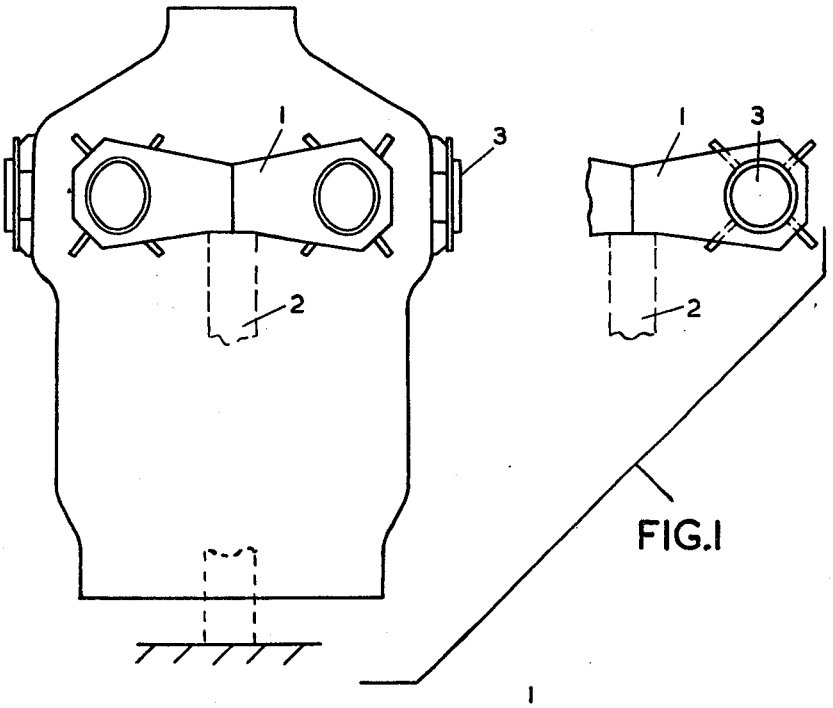

The present invention relates to novel supports for a vessel, for example for a reaction vessel, and to vessels supported by such supports.

Difficulty has been experienced in supporting vessels, particularly reaction vessels, which undergo substantial variations in temperature and possibly pressure from start-up to operating state or subsequently owing to the relative movement which takes place between the vessel and its supports and the attendant changes in forces and moments acting on the vessel and its supports.

Attempts have been made to accommodate such forces and movements between the vessel and supporting structure by, for example, the provision of co-operating sliding surfaces on the support structure and vessel but the sliding surfaces tend to suffer from corrosion and consequent limitation of available movement and, furthermore, are expensive to maintain.

It is an object of the present invention to provide improved means whereby relative movement between a vessel and its supporting structure may be accommodated.

Accordingly, the present invention comprises a supported vessel, the sides of which are provided with a number of outwardly directed projections which are fixed to the outer end of a horizontally-disposed web, the inner end of which is supported on a support point carried on a supporting structure, the lower end of which is secured in the ground; the weight of the vessel being transmitted through the webs to the support structure.

The invention also consists of a support for a vessel comprising a support structure, one end of which is adapted to be secured in the ground, the other end of which supports webs which project outwardly on opposite sides of the support point on the support structure; the outer end of the webs being adapted to be fixed to projections on the outer surface of the vessel to be supported in such a manner that the weight of the vessel is transmitted through the webs to the support structure.

The support structure may be a post, one end of which is adapted to be secured in the ground and the other end of which is fixed to, or supports, the webs which project outwardly on opposite sides of the centre line of the post.

Alternatively, the support structure may consist of a number, for example 3 or more, uprights, each of which is adapted to be secured in the ground and which are then linked by cross-bracing to form a unified structure. In such a case the support points for the webs are provided at appropriate positions, either on the uprights or on the cross-bracing. It will be appreciated that this type of structure may be more rigid than the support structure comprising separate posts and that this increased rigidity may reduce its compliance with movement of the webs in certain directions, particularly linear movement, as described below.

System Utilising Separate Support Posts

The support posts may be of any suitable material to support vessels, for example reaction vessels, above the ground. Such materials are commonly reinforced concrete, steel girders, tubes or the like. The support posts are normally secured in the ground by embedding one end of the post in concrete which may, in turn, be supported by pile(s). The support post may, of course, be of any suitable cross-section and may vary in cross-section over its length, if desired.

The webs are preferably made in one piece, for example from plate metal of suitable thickness and shape although it is possible that the parts of the web on opposite sides of the center line of the support post may be separate or they may be made in two parts and joined in situ by welding, bolting etc. In all cases the centre part of the web is fixed to, or supported on, the support post. Fixing may be by any suitable means such as welding or bolting. If desired the top of the support post may be provided with a recess in which the edge of the web rests and the web itself may be provided with a co-operating recess to prevent lateral movement of the web relative to the support post. Additional fixing means will also normally be used in such cases.

As will be appreciated each support post is provided with webs which project outwardly on each side of the centre line of the support post on the cantiliver principle and because the webs are smaller in thickness than in depth they are compliant in a horizontal direction but remain much less compliant in a vertical direction.

Normally the parts of the web on each side of the centre line of the support post are set at angles to each other of less than 180° in order to follow to some extent the curve of the vessel wall, particularly where this is cylindrical.

There are preferably three support posts (with associated webs) utilised in the support of each vessel. The use of three posts gives the best possible load-sharing and provides a support system which requires less precision in setting up than would systems having more than three support posts. Furthermore, the use of three supports normally allows better access to the space below the vessel, for example for the removal of a base plate and/or access to ducting etc. By the use of three support posts normal differential settlement does not substantially affect the load sharing by the support posts.

The posts of outwardly directed projections from the vessel wall (to which the webs are fixed) is of advantage in that it allows improved access to the exterior of the wall, for example when testing with ultra-sonic sound generating equipment for corrosion of the vessel wall.

The compliance of the webs in a horizontal direction is also valuable in that distortion of the vessel wall is minimised and, consequently, damage to the lining, particularly where that lining is of relatively brittle refractory material.

System Utilising a Unified Structure Comprising Posts Linked by Cross-bracing This type of construction of the support structure normally consists of posts and associated cross-bracing which form an open structure which may surround at least part of the lower half of the vessel. Support points for the webs are provided at suitable positions on the cross-bracing between the posts. For example where rectangular bracing is provided between four posts together with cross-bracing between the sides of the rectangle, one support point may be provided on the rectangular bracing and two support posts on the cross-bracing. It is preferred to provide only three such support points for the webs, the ends of the webs being fixed to projections on the outside of the vessel to be supported.

It will be appreciated that this type of structure may be more rigid than the support provided by separate posts and that this increased rigidity may reduce the compliance of the support system to movement in certain directions, particularly to linear movement of the webs due to thermal expansion, for example when the webs are heated by heat conduction and/or radiation from the vessel being supported. Under these circumstances it may be advisable to modify the support points for the webs in order to avoid distortion of the shell of the vessel and/or the support structure.

One method whereby compliance to linear movement of the web can be obtained is to provide support points consisting of a base plate adapted to be fixed to the support structure a support point, the base plate being provided with uprights at opposite ends which, in turn, are fixed to the ends of two vertical metal plates, these plates being spaced apart sufficiently to accomodate any lateral movement of the webs. The opposing ends of the webs, i.e. the opposite ends to those fixed to the projection on the vessel are then welded or otherwise secured to the outside of the opposing spaced-apart metal plates. Any linear movement of the webs is thus accommodated by movement of the spaced-apart metal plates. Such a structure is exemplified in FIGS. 5 and 5A of the accompanying drawings.

It will, of course, be appreciated that movements other than linear movements of the webs are accommodated by compliance of the webs as described earlier in this specification in connection with supporting structures consisting of separate posts.

The drawings accompanying the specification show side and plan views of the present invention and details of the one embodiment of a unified support structure and support point for use with such a unified structure of posts and cross-bracing.

In particular

Figure 1A:
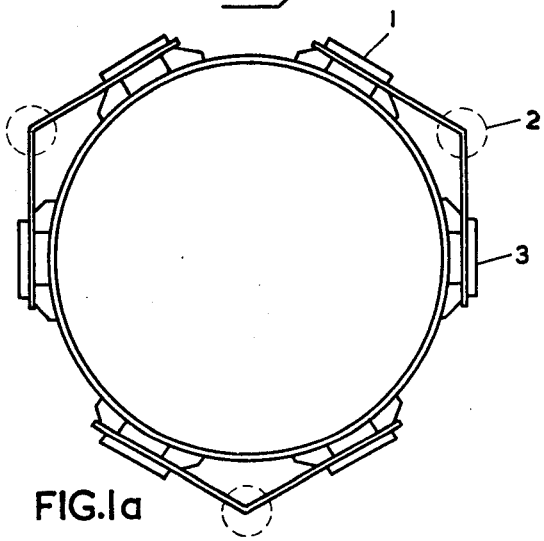

FIGS. 1 and 1A show webs 1 attached to post 2 and fixed to circular projections 3 on the vessel.

Figure 2:
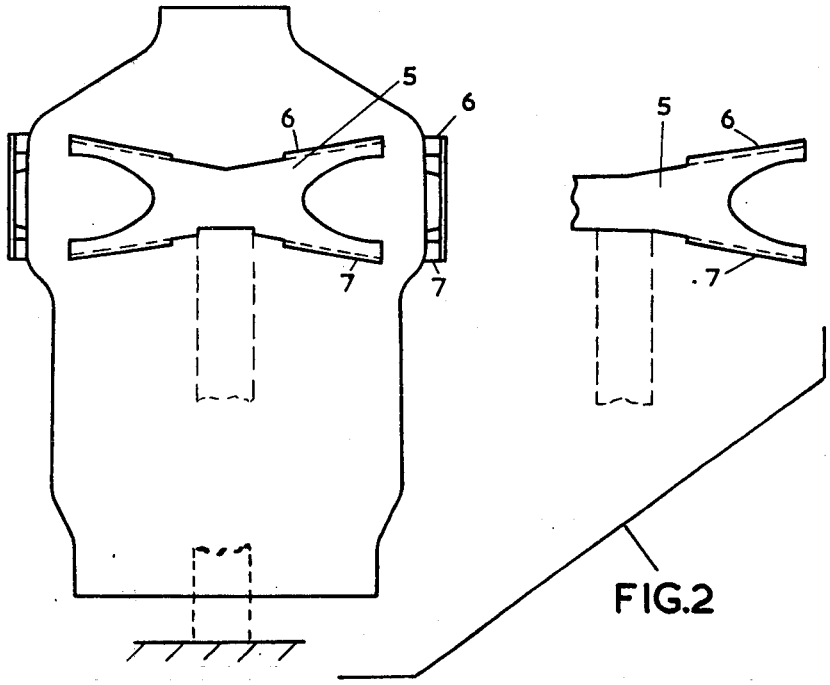
Figure 2A:
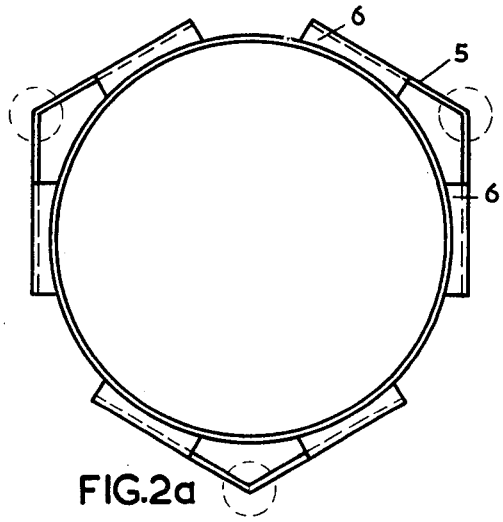
Figure 3:
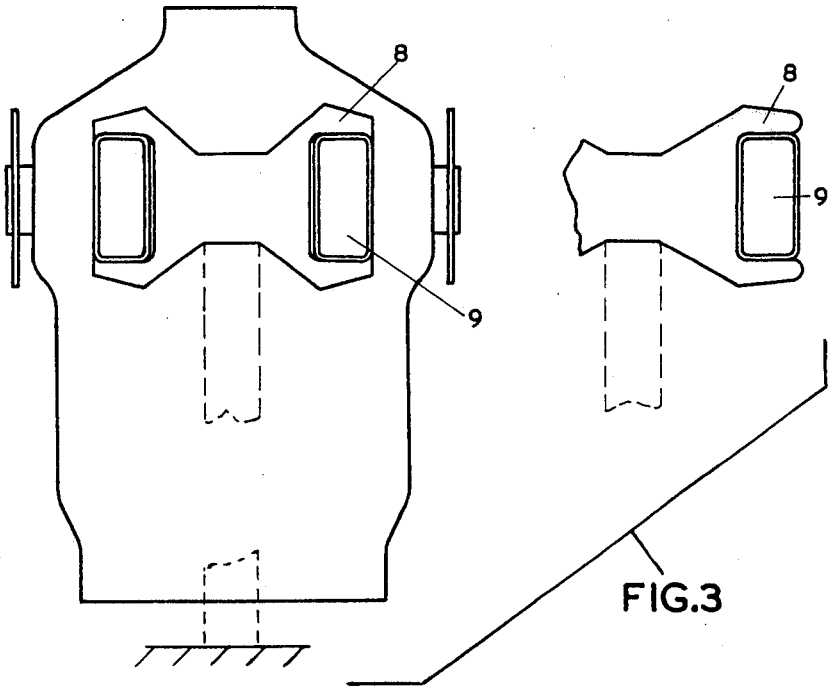
Figure 3A:
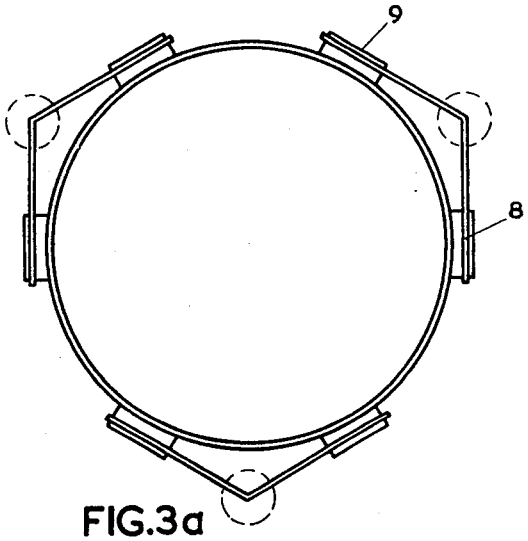

FIGS. 2 and 2A show webs 5 the top and bottom edges 6 and 7 of which are bent inwardly and welded to the vessel to form the projections on the vessel and FIGS. 3 and 3A shows a similar embodiment to that in FIGS. 2 and 2A but in which the web has jaws 8 and the vessel is provided with projections 9.

Figure 4:
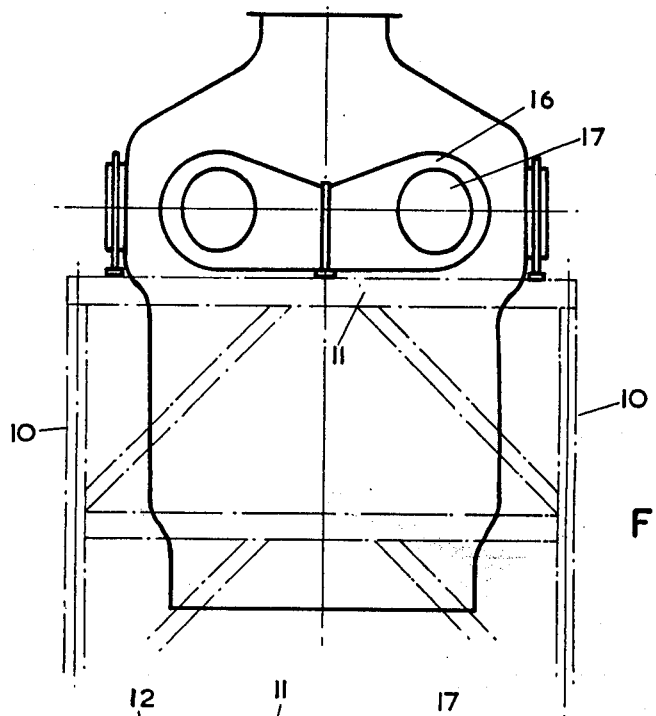
Figure 4A:
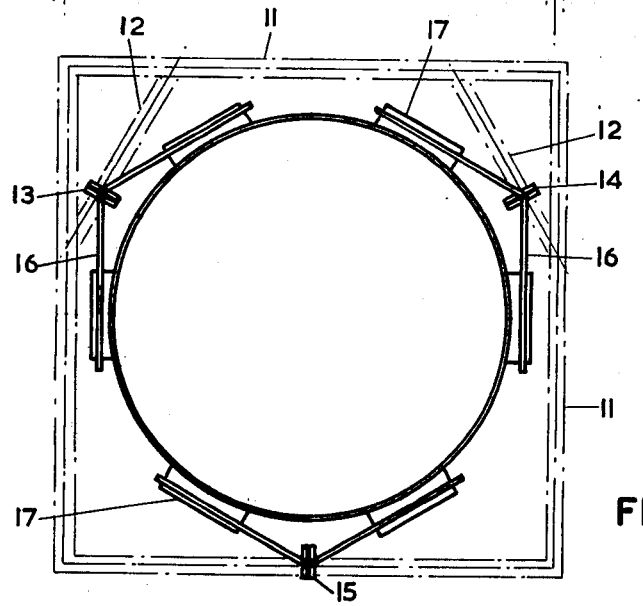

FIGS. 4 and 4A show a side and cross-sectional plan view of a unified support structure consisting of four posts 10 with bracings 11 forming a rectangle and bracings 12 joining the sides of the rectangle. Support points 13, 14 and 15 are provided for webs 16 fixed to projections 17.

Figure 5:
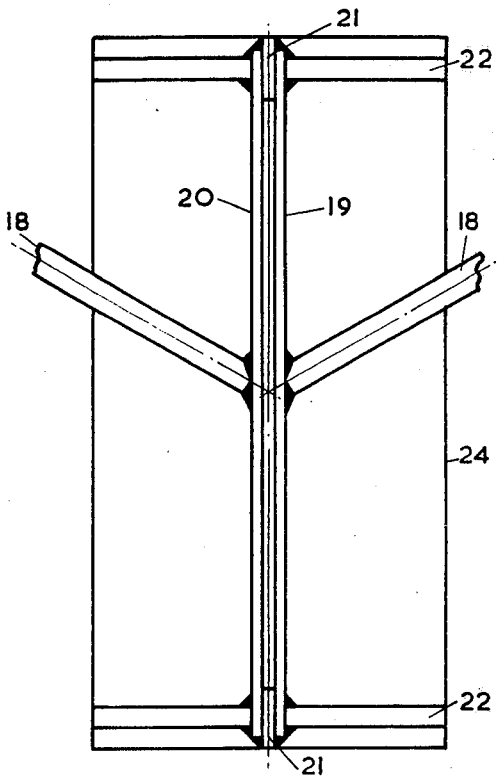
Figure 5A:
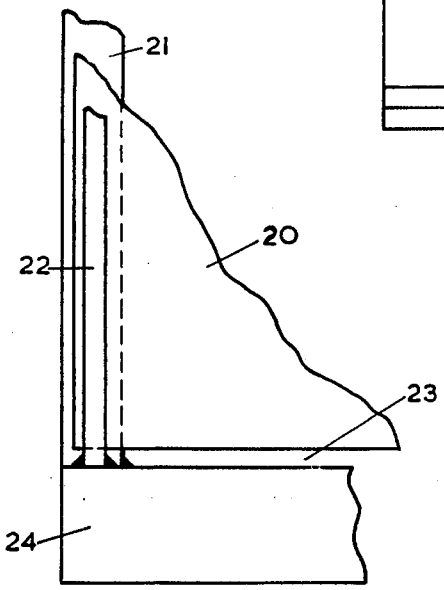

FIGS. 5 and 5A show one embodiment of a support point adapted to comply with linear movement of webs. FIG. 5 is a plan view of the support point of this embodiment which would be located, for example, at point 15 in FIG. 4A. Webs 18 are attached to the spaced-apart plates 19 and 20. Spacers 21 are provided between each end of the plates and the ends of the plates (and the spacers) are supported on uprights 22 by, for example, welding as best shown in FIG. 5. The plates, spacers and uprights are fixed to base plate 24 which is, in turn, fixed to the supporting structure as shown, for example, in FIGS. 4 and 4A to provide a supporting point. FIG. 5A is a fragmentary side elevation view taken along line **5*a*—5*a* of FIG. 5, showing a gap 23 between the spaced-apart plates 19 and 20 and base plate 24** (Some welds are omitted for clarity).

In FIGS. 1 to 3, three separate posts are shown as the supporting structure. The number of posts may, of course, be varied as desired, as may the shape of the projections and co-operating "jaws" on the webs but, as previously noted, three support posts per vessel are preferred, at least where separate posts are used.

In all embodiments compliance of the web(s) at least to radial movements of the shell, may be improved by utilising a number of parallel webs (in place of a single web) between the support point and the projection(s) on the outer surface of the vessel, each of the parallel webs normally being of reduced thickness when compared with a single web utilised for the same duty.

What is claimed is:

1. A supported vessel comprising:

a. a vessel, the sides of which are provided with a number of outwardly directed projections, and b. a support comprising a plurality of support points carried on a support structure, the lower end of which is secured in the ground, said support points supporting webs which project outwardly on opposite sides of said support points, said webs being of thickness and shape such that they are complant in a horizontal direction, the center part of each web being fixed to a support point and the outer ends of each web being adapted to be fixed to a projection on said vessel such that the weight of said vessel is projected through said webs to the support structure and the horizontal compliance of said webs accommodates horizontal movement of the vessel wall.

2. A supported vessel as claimed in claim 1 wherein the vessel is provided with six outwardly directed projections and wherein the support structure comprises three separate posts, each post supporting a support point for two webs.

3. A supported vessel as claimed in claim 1 wherein the support structure comprises at least three posts interconnected by cross-bracing members, the support points being located either on a post or on a cross-bracing member.

4. A supported vessel as claimed in claim 3 wherein the supporting structure comprises four posts interconnected by cross-bracing.

5. A supported vessel as claimed in claim 4 wherein cross-bracing members form a rectangle between the posts and cross-bracing members are provided between the members forming the sides of the rectangle and wherein two support points are located on members between the sides of the rectangle and one support point is located on a member forming a side of the rectangle.

6. A supported vessel as claimed in claim 1 wherein a support point is provided with a recess and the webs supported thereon are provided with a co-operating recess thereby preventing lateral movement of the web.

7. A supported vessel as claimed in claim 1 wherein the support points on the support structure are so formed as to allow compliance to linear movement of the webs connected thereto.

8. A supported vessel as claimed in claim 7 wherein the support point comprises a base plate fixed to uprights, spacers and spaced-apart plates between the uprights; the ends of the webs supported by the support point being fixed to opposing spaced-apart plates.

* * * * *